US010720723B2

(12) United States Patent
Zhao et al.

(10) Patent No.: US 10,720,723 B2
(45) Date of Patent: Jul. 21, 2020

(54) ELECTRICAL CONNECTOR HAVING CONTACTS PLATED WITH TWO DIFFERENT MATERIALS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 110 days.

(21) Appl. No.: 16/159,570

(22) Filed: Oct. 12, 2018

(65) Prior Publication Data

US 2019/0115678 A1 Apr. 18, 2019

(30) Foreign Application Priority Data

Oct. 12, 2017 (CN) ..... 2017 1 0945984

(51) Int. Cl.

| | |
|---|---|
| ***H01R 13/03*** | (2006.01) |
| ***C22C 28/00*** | (2006.01) |
| ***C22C 5/02*** | (2006.01) |
| ***H01R 13/40*** | (2006.01) |
| ***H01R 13/6471*** | (2011.01) |
| ***C22C 5/04*** | (2006.01) |
| ***H01R 24/60*** | (2011.01) |

(Continued)

(52) U.S. Cl.

CPC ..... *H01R 13/03* (2013.01); *C22C 5/02* (2013.01); *C22C 5/04* (2013.01); *C22C 28/00* (2013.01); *H01R 13/40* (2013.01); *H01R 13/6471* (2013.01); *H01R 24/60* (2013.01); *H01R 13/405* (2013.01); *H01R 2107/00* (2013.01)

(58) Field of Classification Search

CPC ..... H01R 13/03

See application file for complete search history.

(56) References Cited

U.S. PATENT DOCUMENTS 4,044,888 A * 8/1977 Schachter ..... H01R 43/205 206/717

4,069,370 A * 1/1978 Harmsen ..... H01H 1/023 200/266

(Continued)

FOREIGN PATENT DOCUMENTS

CN 105375157 A 3/2016

*Primary Examiner* — James Harvey

(74) *Attorney, Agent, or Firm* — Wei Te Chung; Ming Chieh Chang

(57) ABSTRACT

An electrical connector includes: an insulative housing; and a row of contacts secured to the insulative housing, the row of contacts including one or more power contacts and one or more signal and/or ground contacts, wherein the one or more power contacts are plated with a first material and the one or more signal and/or ground contacts are plated with a second material different from the first material. A related method of manufacturing such connector includes separate plating of the row of power contacts from the row of signal and ground contacts with a different material.

18 Claims, 10 Drawing Sheets

(51) Int. Cl.
*H01R 107/00* (2006.01)
*H01R 13/405* (2006.01)

(56) References Cited

U.S. PATENT DOCUMENTS

| | | | | | |
|---|---|---|---|---|---|
| 4,415,635 | A * | 11/1983 | Wilsdorf | H01R 39/24 | 310/248 |
| 4,778,231 | A * | 10/1988 | Seidler | H01R 13/193 | 439/295 |
| 4,870,227 | A * | 9/1989 | Saen | H01R 4/029 | 174/117 FF |
| 4,971,758 | A * | 11/1990 | Suzuki | C22C 9/04 | 420/472 |
| 5,957,739 | A * | 9/1999 | Bianca | H01R 43/16 | 439/876 |
| 6,325,644 | B1 * | 12/2001 | Lemke | H01R 12/716 | 439/83 |
| 2017/0271800 | A1 | 9/2017 | Wagman et al. | | |
| 2018/0030608 | A1 | 2/2018 | Kwok et al. | | |
| 2018/0087171 | A1 * | 3/2018 | Tsai | C25D 5/34 | |
| 2019/0115678 | A1 * | 4/2019 | Zhao | H01R 13/03 | |
| 2019/0323136 | A1 * | 10/2019 | Kobayashi | C25D 5/44 | |
| 2019/0337268 | A1 * | 11/2019 | Kobayashi | C25D 7/00 | |
| 2020/0005963 | A1 * | 1/2020 | Kubota | C25D 7/0607 | |

* cited by examiner

ELECTRICAL CONNECTOR HAVING CONTACTS PLATED WITH TWO DIFFERENT MATERIALS

BACKGROUND OF THE INVENTION

1. Field of the Invention

The present invention relates to an electrical connector having a row of contacts, including one or more power contacts and one or more signal and/or ground contacts, wherein the one or more power contacts are plated with a corrosion resistant material, and also to a method of manufacturing such electrical connector having two groups of contacts respectively plated with two different materials.

2. Description of Related Arts

U.S. Patent Application Publication No. 2017/0271800 discloses connector contacts that include a layer or portion formed of a precious-metal alloy to improve corrosion resistance. The precious-metal-alloy layer may be plated for further corrosion resistance and wear improvement. Resources may be conserved by forming a bulk or substrate region of the contact using a more common material, such as copper or a material that is primarily copper based. The precious-metal alloy layer may be plated with a hard, durable, wear and corrosion resistant plating stack formed of one or more plating layers. A top plate may be plated to provide a durable contacting surface and may be formed using rhodium ruthenium, dark rhodium, dark ruthenium, gold copper, or other alternatives. The use of rhodium ruthenium or rhodium may help oxygen formation, which may reduce its corrosion.

U.S. Patent Application Publication No. 2018/0030608 discloses a method of forming a contact, comprising the steps of: stamping a contact; plating at least a first portion of the contact with a leveling agent; and plating at least a portion of the first portion with a binary alloy by applying a signal to the contact and at least partially submerging the contact in a bath. The binary alloy comprises a first element in a first group consisting of platinum, palladium, iridium, osmium, rhodium, and ruthenium, and a second element in a second group consisting of platinum, palladium, iridium, osmium, rhodium, and ruthenium, where the second element is different from the first element. The first element may be selected for its ability to plate onto a contact. This ability to plate may help to simplify the manufacturing process and help to reduce or control an amount of resources, such as precious metals, consumed. The first element may further be selected to provide a good catalyst such that water on a contact is converted into oxygen. This may help to prevent the plated material from dissolving in the presence of moisture, particularly when a contact is providing a voltage.

SUMMARY OF THE INVENTION

An electrical connector comprises: an insulative housing; and a row of contacts secured to the insulative housing, the row of contacts including one or more power contacts and one or more signal and/or ground contacts, wherein the one or more power contacts are plated with a first material and the one or more signal and/or ground contacts are plated with a second material different from the first material. A related method of manufacturing such connector comprises the steps of: forming a row of power contacts and plating the row of power contacts with a first material; forming a row of signal and ground contacts and plating the row of signal and ground contacts with a second material different from the first material; arranging the row of power contacts among the row of signal and ground contacts into a single row; and insert molding the single row of contacts with an insulative housing.

DETAILED DESCRIPTION OF THE PREFERRED EMBODIMENT

Figure 1:
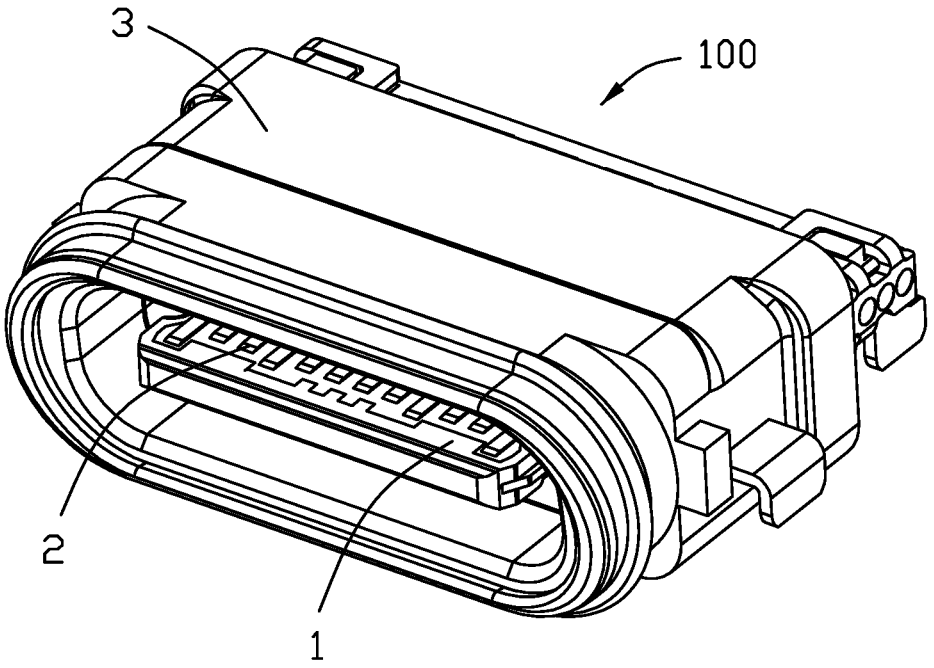
FIG. 1 is a front and top perspective view of an electrical connector in accordance with the present invention.
Figure 2:
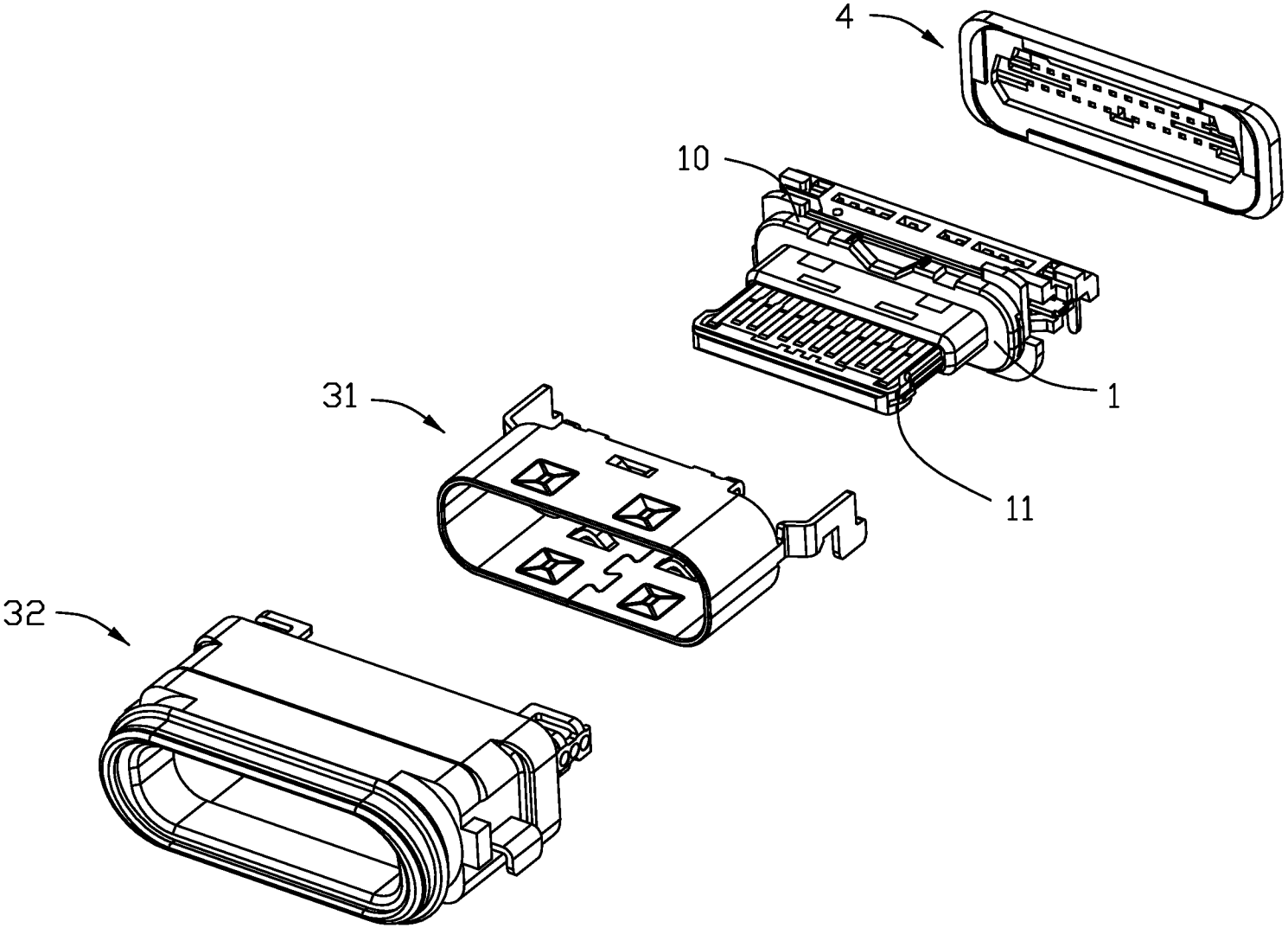
FIG. 2 is an exploded view of the electrical connector.
Figure 3:
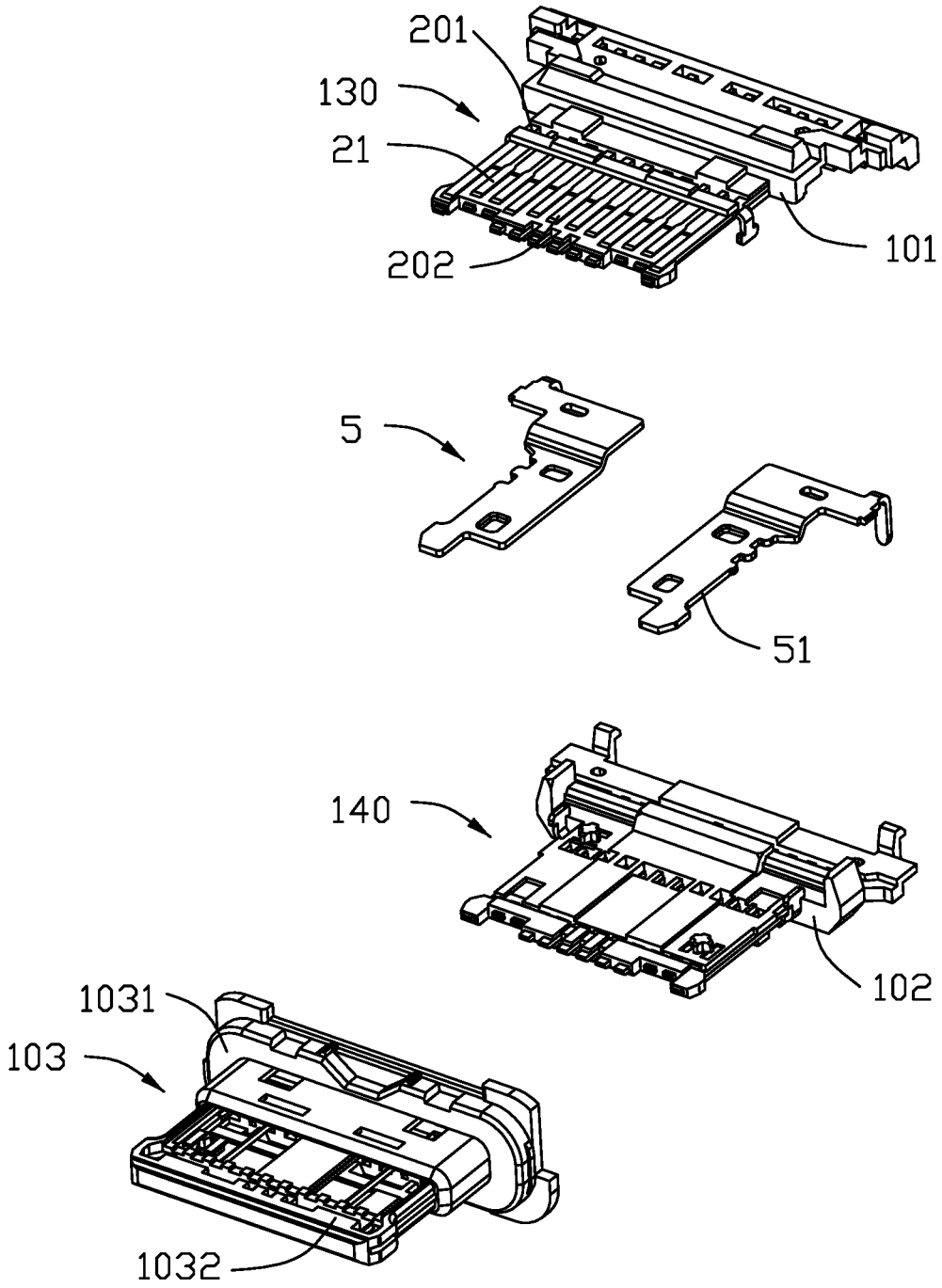
FIG. 3 is an exploded view of the electrical connector omitting a cover thereof.
Figure 4:
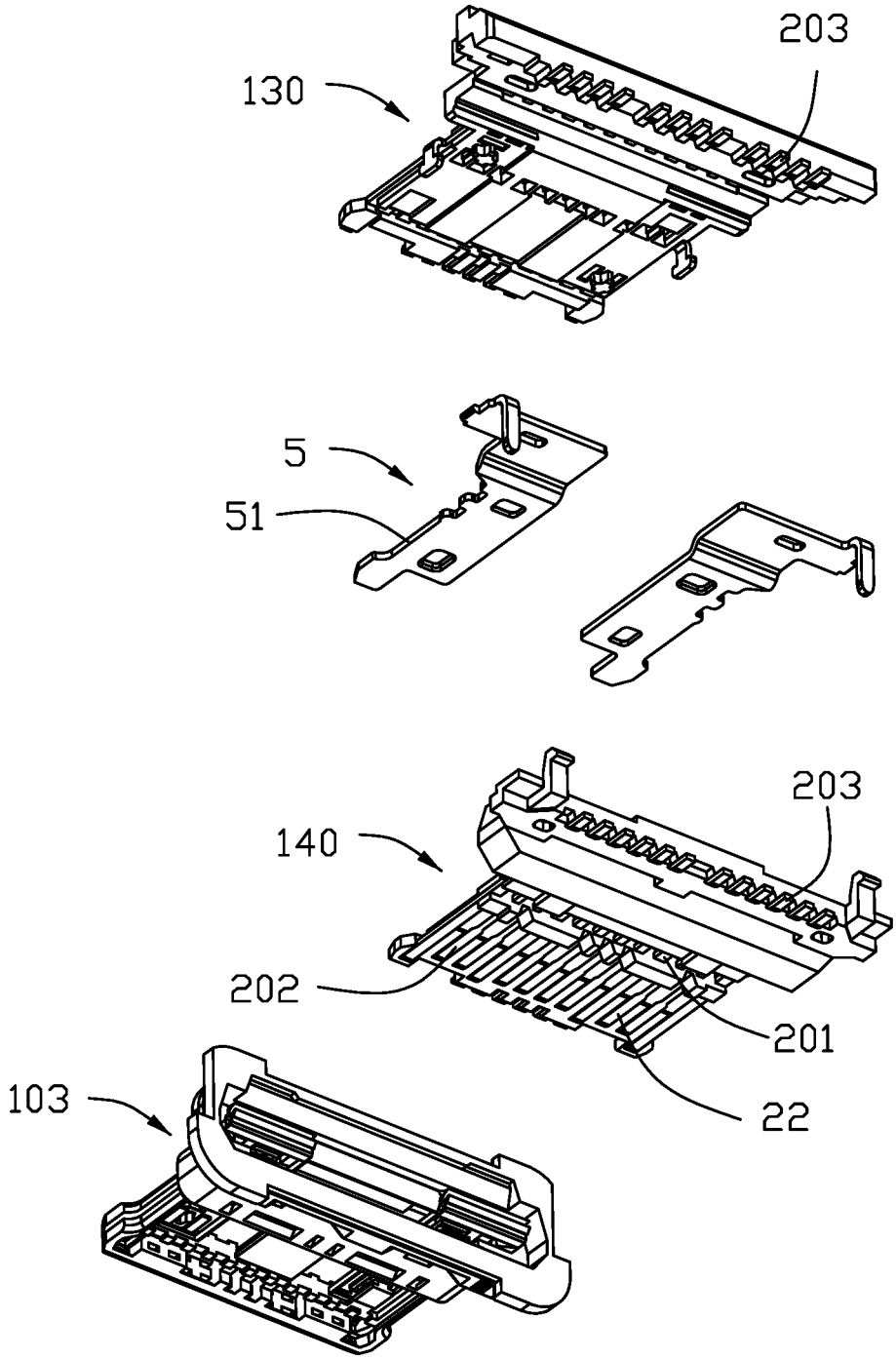
FIG. 4 is a view similar to FIG. 3 but from another perspective.
Figure 5:
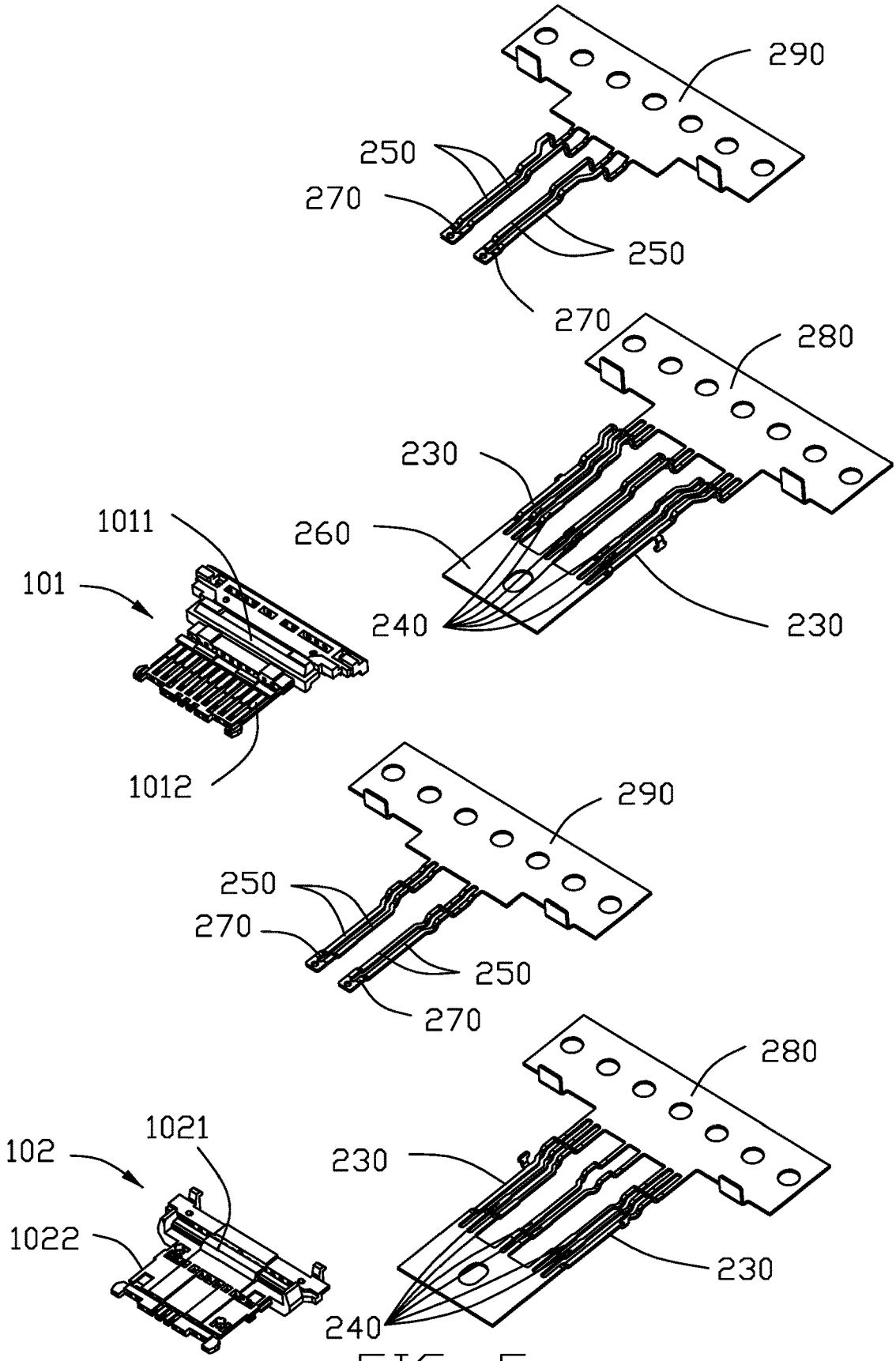
FIG. 5 is an exploded view of upper and lower rows of contacts and first and second insulators of the electrical connector according to a first embodiment.
Figure 6:
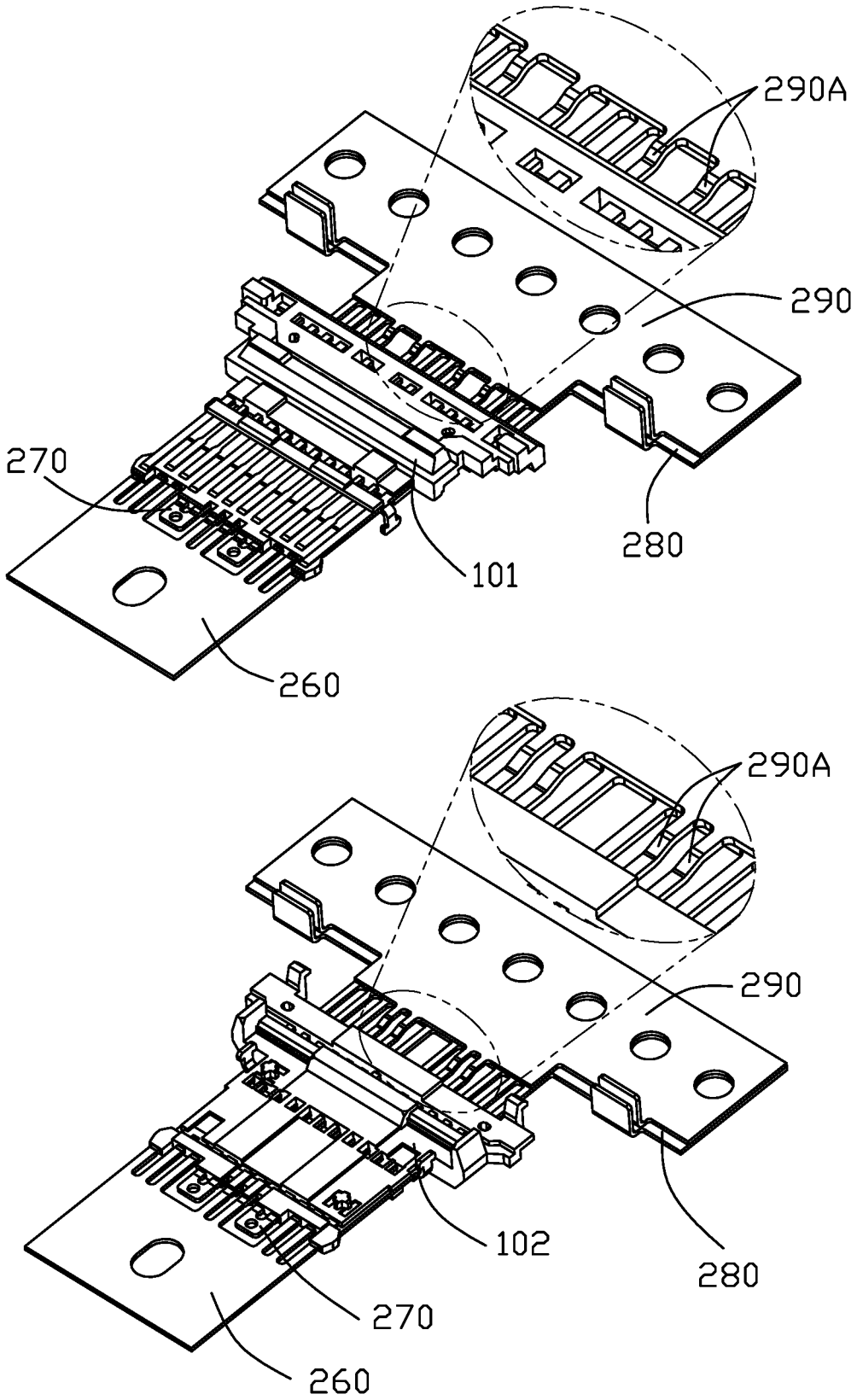
FIG. 6 is a view similar to FIG. 5 but showing the upper row of contacts assembled with the first insulator and the lower row of contacts assembled with the second insulator.

Referring to FIGS. 1-10, an electrical connector 100 comprises an insulative housing 1 and at least one row of contacts 2 secured to the insulative housing via an insert-molding process. The electrical connector may further comprise a cover 3 having a metal shield 31 and an insulative shell 32 and a rear sealing element 4. In the embodiment shown the contacts 2 include an upper row of contacts 21 and a lower row of contacts 22 which are reversely symmetrically arranged with each other as shown in the USB (Universal Serial Bus) Type C connector. The insulative housing 1 has a base 10 and a tongue 11. Each of the upper and lower contacts 21 and 22 has a retaining portion 201, an exposed contacting portion 202, and a soldering portion 203. A shielding plate 5 may be further provided between the upper row of contacts 21 and the lower row of contacts 22. The plate 5 may have a side notch 51.

Referring specifically to FIGS. 1-6, the insulative housing 1 may be formed in one or more forming operations with the two rows of contacts and may comprise a first insulator/housing 101, a second insulator/housing 102, and a third insulator/housing 103 insert/over molded in a known manner through first and second contact modules 130 and 140. The first insulator 101 integrally formed with the upper row of contacts 21 via an insert-molding process, has a base portion 1011 and a tongue portion 1012; the second insulator 102 integrally formed with the lower row of contacts 22 via another insert-molding process, has a base portion 1021 and a tongue portion 1022; the third insulator 103 has a base portion 1031 and a tongue portion 1032. The base portions

1011, 1021, 1031 constitute the overall base 10; the tongue portions 1012, 1022, 1032 constitute the overall tongue 11.

Each row of contacts 21 or 22 include ground contacts 230, signal contacts 240, and power contacts 250. The contacting portion 2021 of the power contact 250 and the contacting portions 2021 of the ground contact 230 and the signal contact 240 are plated with different materials. Specifically, the contacting portion 2021 of the power contact 250 is plated with rhodium ruthenium alloy and the contacting portions 2021 of the ground contact 230 and the signal contact 240 are plated with gold.

In the embodiment shown each row of contacts comprises two pairs of power contacts 250, three pairs of signal contacts 240 interposed by the two pairs of power contacts 250, and two outermost ground contacts 230. The rhodium ruthenium alloy is known to be plated by at least partially submerging the contact in a bath, which is comparatively more expensive than plating of gold through selective masking.

In order to reduce manufacturing cost, in accordance with the first embodiment of the present invention, front ends of the contacting portions 202 of the ground contacts 230 and the signal contacts 240 are connected by a (front/first) carrier portion 260, and front ends of the contacting portions 202 of each pair of power contacts 250 are connected by a respective (front/second) carrier portion 270, wherein the size of the carrier portion 270 is considerably smaller than the size of the carrier portion 260. Since the carrier portion 270 has a small size, when the contacting portions 202 of the power contacts 250 are immersed in a plating bath, plating material consumed is therefore less.

The soldering portions 203 of the ground contacts 230 and the signal contacts 240 are connected by a (rear/first) carrier portion 280; the soldering portions 203 of the power contacts 250 are connected by a (rear/second) carrier portion 290. The carrier portions 260, 270, 280, 290 are cut after the contacts and associated insulators are insert molded, as is well known in this art. In this embodiment, the rear carrier portion 290 is upwardly offset from the rear carrier portion 280 via the offset region 290A of the rear carrier portion 290 even though the contacting portions 2021 of both power contacts 250 and signal/ground contacts 240/230 are coplanar with each other.

Figure 7:
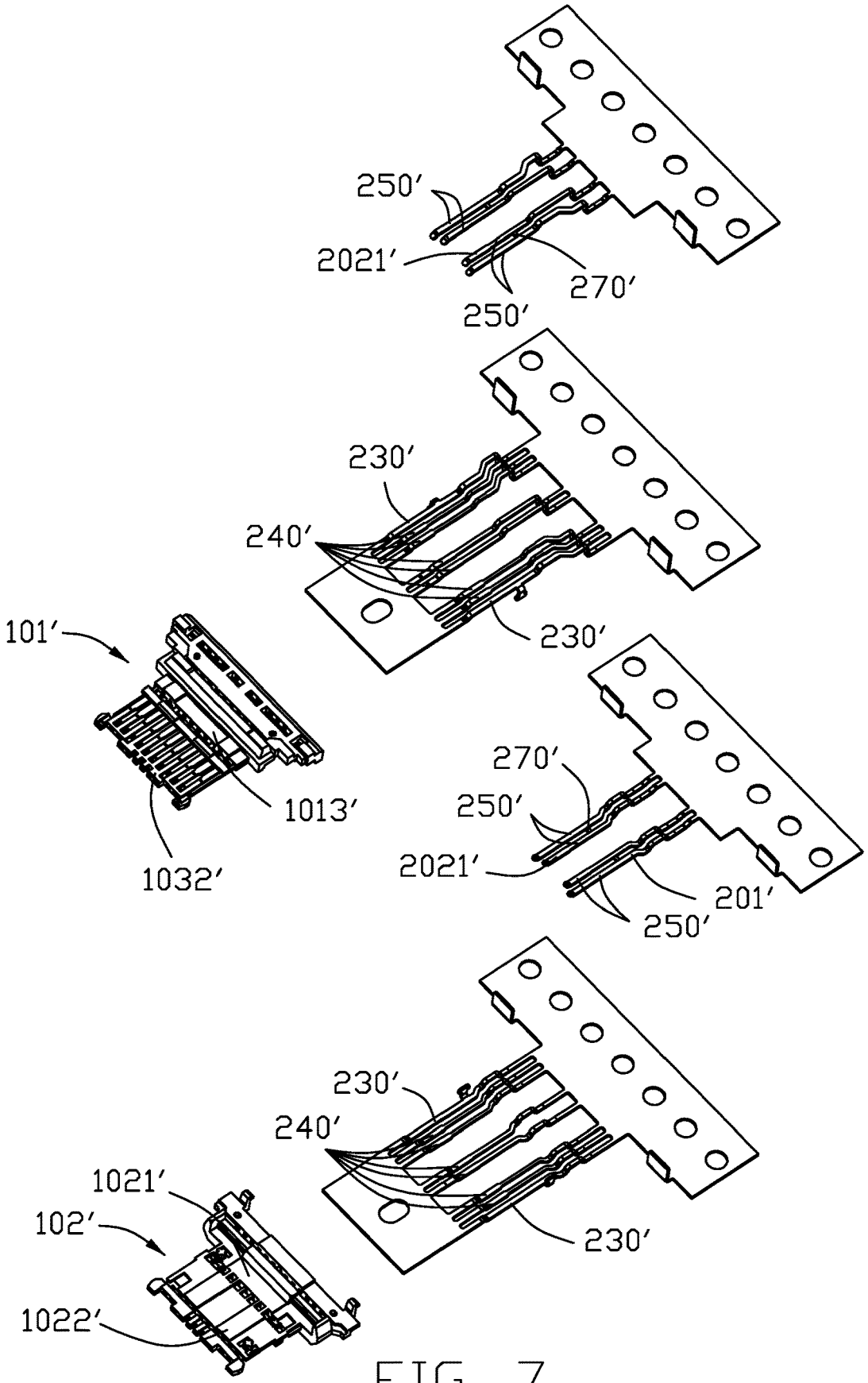
FIG. 7 is an exploded view of upper and lower rows of contacts and first and second insulators of the electrical connector according to a second embodiment.
Figure 8:
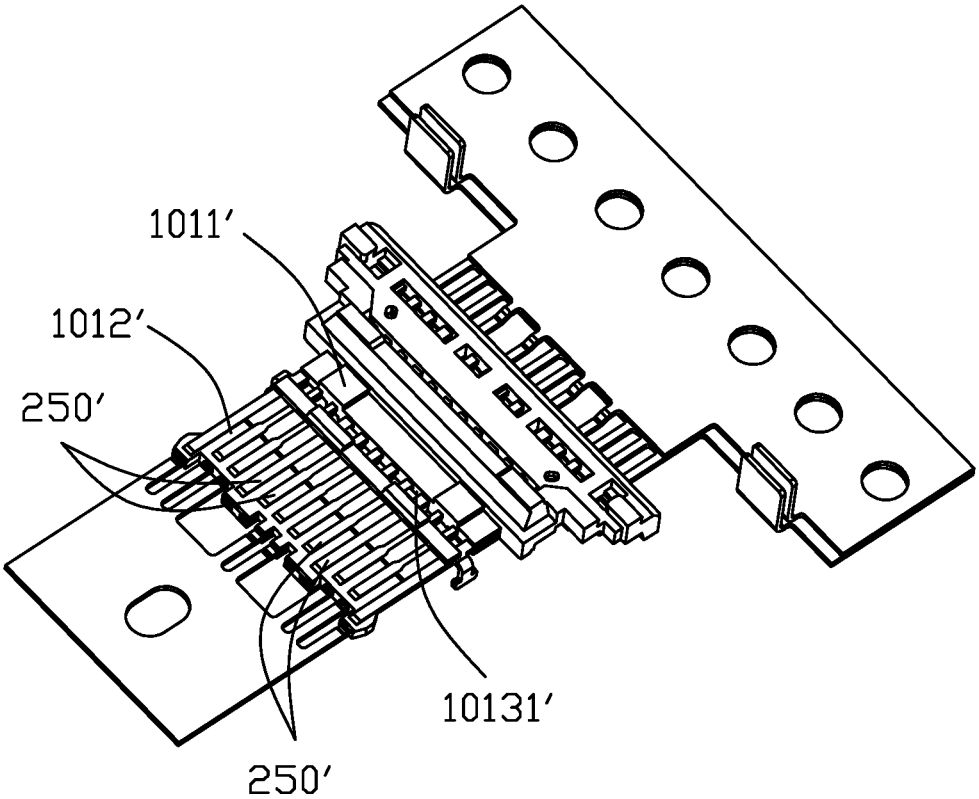
FIG. 8 is a view similar to FIG. 7 but showing the upper row of contacts assembled with the first insulator and the lower row of contacts assembled with the second insulator.
Figure 8:
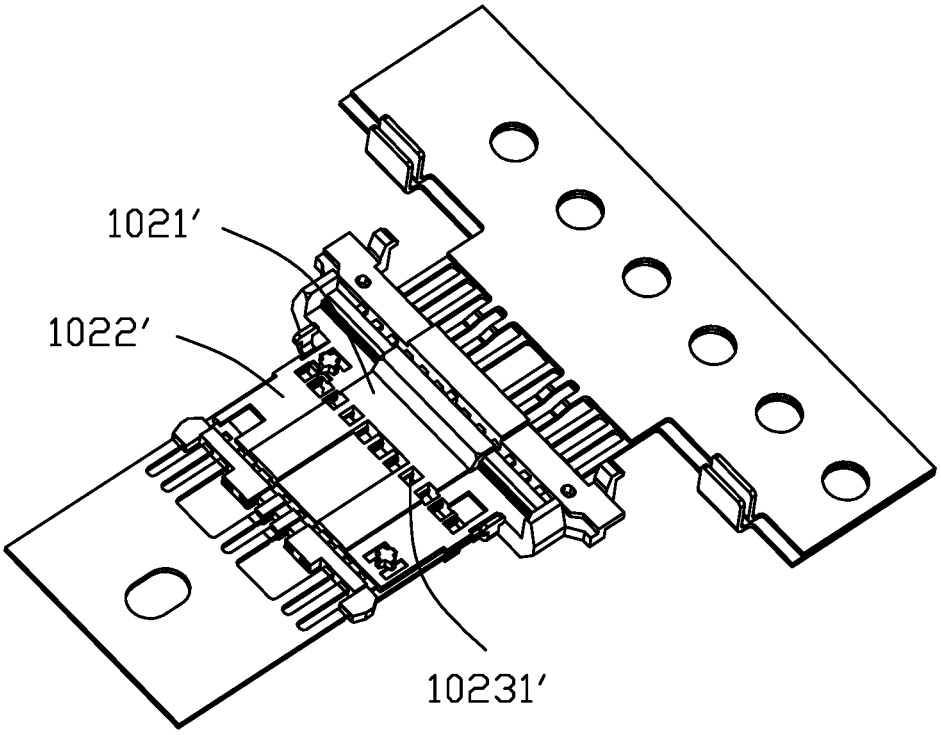

Referring specifically to FIGS. 7 and 8, the second embodiment shown differs from the first embodiment only in that a respective bridge 270' is provided instead for interconnecting the contacting portions of each pair of power contacts 250'. The bridges 270' are cut afterwards by way of holes 10131' and 10231' on step portions 1013' and 1023' of first and second insulator bases 1011' and 1021'.

Figure 9:
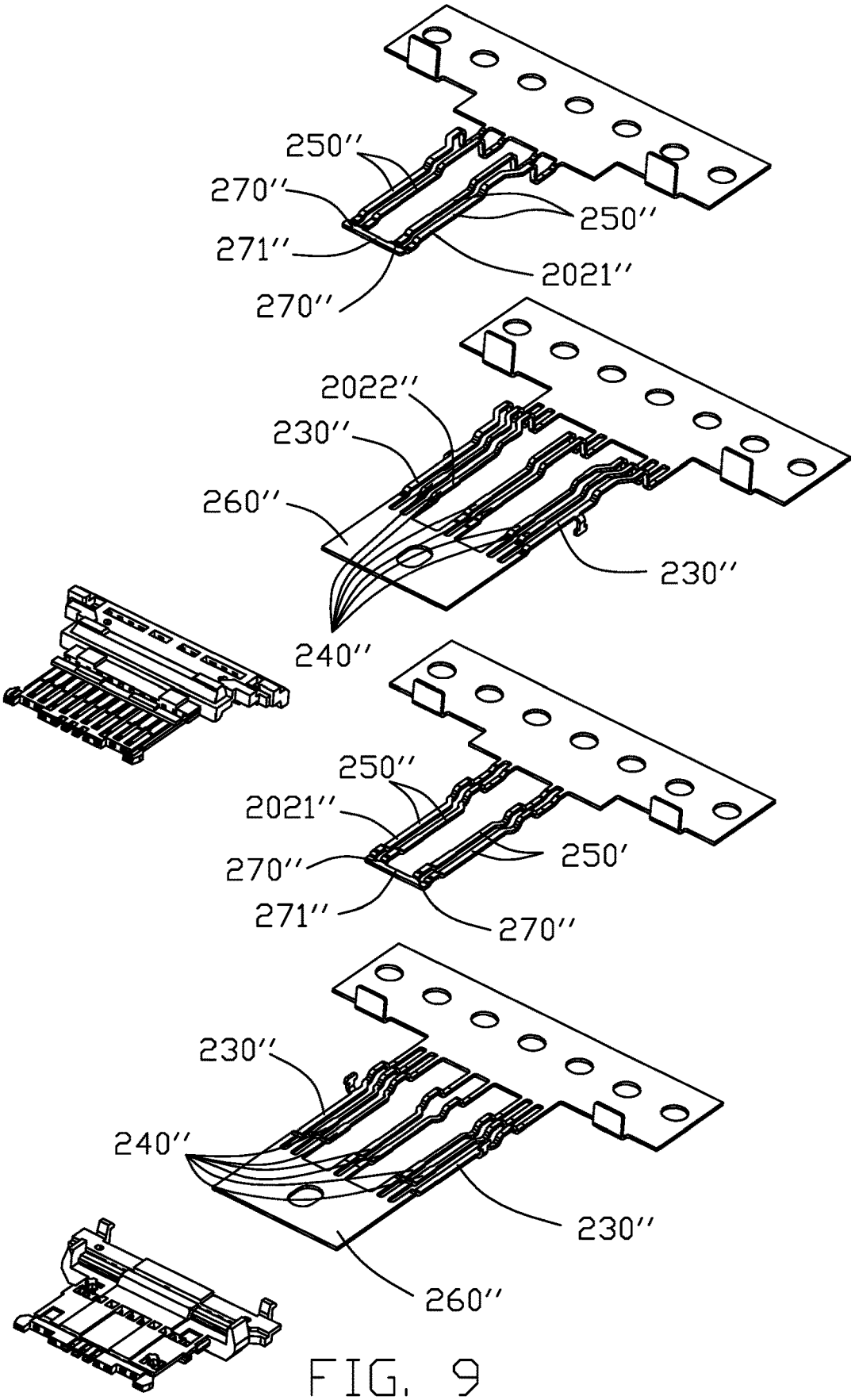
FIG. 9 is an exploded view of upper and lower rows of contacts and first and second insulators of the electrical connector according to a third embodiment.
Figure 10:
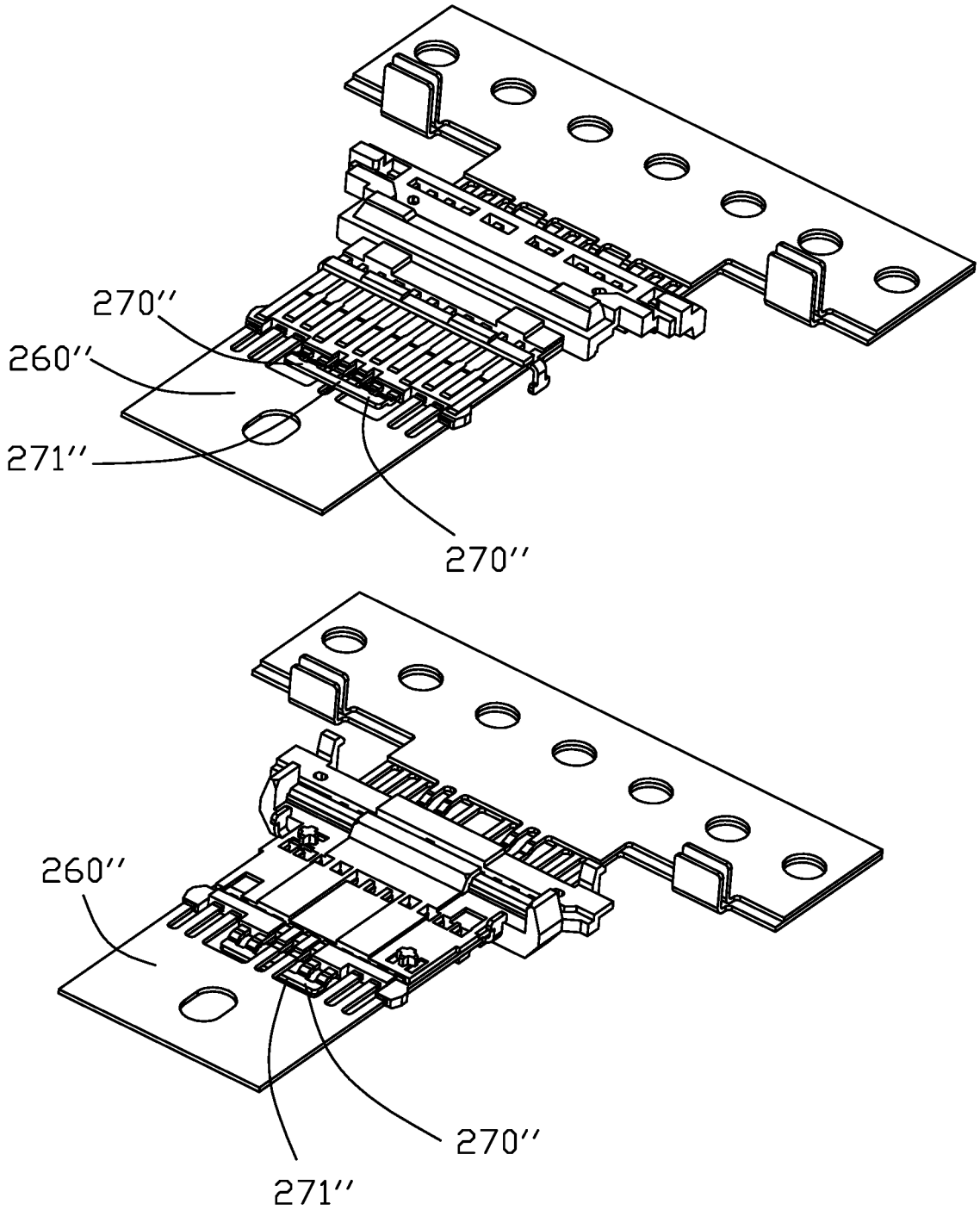
FIG. 10 is a view similar to FIG. 9 but showing the upper row of contacts assembled with the first insulator and the lower row of contacts assembled with the second insulator.

Referring specifically to FIGS. 9 and 10, the third embodiment shown differs from the first embodiment only in that a bridge 271" is further provided for interconnecting carrier portions 270" on front ends 2021" of the contacting portions of the power contacts 250". The bridge 271" aids in positioning the power contacts 250" during processing and is cut afterwards.

Separate plating of the power contacts from the ground and signal contacts and special arranging of the power contact carrier help to reduce or control an amount of resources, such as rhodium, ruthenium, or rhodium ruthenium, consumed.

What is claimed is:

1. An electrical connector comprising:

an insulative housing; and a row of contacts secured to the insulative housing, the row of contacts including one or more power contacts and one or more signal and/or ground contacts, wherein the one or more power contacts are plated with a first material and the one or more signal and/or ground contacts are plated with a second material different from the first material; wherein the row of contacts comprises two pairs of power contacts, three pairs of signal contacts interposed by the two pairs of power contacts, and two outermost ground contacts.

2. The electrical connector as claimed in claim 1, wherein the first material contains rhodium, ruthenium, or rhodium ruthenium.

3. An electrical connector comprising:

an insulative housing; and a row of contacts integrally secured to the insulative housing via an insert-molding process, the row of contacts including a plurality of signal/ground contacts originally linked to a first rear carrier portion, and a plurality of power contacts which are originally linked by a second rear carrier portion, each of said contacts including a contacting portion; wherein the power contacts are equipped with a first material and the signal/ground contacts are equipped with a second material more expensive than the first material; wherein a numerical of the power contacts is smaller than that of the signal/ground contact, and the first rear carrier portion is offset from the second rear carrier portion in a vertical direction so as to allow the contacts to be integrally secured to the insulative housing via said insert-molding process while the contacting portions of all contacts are coplanar with one another; wherein both the first rear carrier portion and the second rear carrier portion are removed from the corresponding contacts after the insert-molding process.

4. The electrical connector as claimed in claim 1, wherein both the one or more power contacts and the one of more signal and/or ground contacts are integrally formed with the housing via an insert-molding process.

5. The electrical connector as claimed in claim 4, wherein the one or more power contacts are originally unitarily extending between a front carrier portion and a rear carrier portion at two opposite ends of the more power contacts in a front-to-back direction, and the more signal and/or ground contacts are originally unitarily extending between another front carrier portion and another rear carrier portion at two opposite ends of the more signal and/or ground contacts in the front-to-back direction, and wherein said rear carrier portion and said another rear carrier portion are offset from each other in a vertical direction during the insert-molding process and are removed after said insert-molding process.

6. The electrical connector as claimed in claim 5, wherein said front carrier portion and said another carrier portion are either coplanar or offset with each other in a vertical direction.

7. A method of manufacturing an electrical connector, comprising the steps of:

forming a row of power contacts and plating the row of power contacts with a first material;

forming a row of signal and ground contacts and plating the row of signal and ground contacts with a second material different from the first material;

arranging the row of power contacts among the row of signal and ground contacts into a single row; and insert molding the single row of contacts with an insulative housing via an insert-molding process; said row of signal and ground contacts are originally unitarily formed with a rear carrier portion, and said row of power contacts are originally unitarily formed with another rear carrier portion offset from said rear carrier portion in a vertical direction during the insert-molding process and both are removed from the corresponding contacts after the insert-molding process.

8. The method as claimed in claim 7, wherein the step of stamping the row of power contacts comprises stamping out a pair of power contacts interconnected with each other.

9. The method as claimed in claim 7, wherein the step of stamping the row of power contacts comprises stamping out a first pair of power contacts and a second pair of power contacts interconnected with the first pair.

10. The electrical connector as claimed in claim 3, wherein there are twelve positions from number one to number twelve in a transverse direction, and said power contacts are located at positions four, five, eight and nine, and the signal/ground contacts are located at the remainders.

11. The method as claimed in claim 7, wherein said row of signal and ground contacts are further originally unitarily formed with a front carrier portion, and said row of power contacts are further originally unitarily formed with another front carrier portion, said front carrier portion and said another front carrier portion being either coplanar or offset with each other in a vertical direction.

12. The method as claimed in claim 11, wherein the front carrier portion is smaller than said another front carrier portion.

13. The method as claimed in claim 7, wherein one of said rear carrier portion and said another rear carrier portion includes an offset region so as to have said rear carrier portion and said another rear carrier portion offset from each other in the vertical direction.

14. The method as claimed in claim 7, further providing another insulative housing integrally formed with another single row of contacts via another insert-molding process and further cooperating with said insulative housing to commonly sandwich a metallic shielding plate therebetween in a vertical direction with a further over-molding process.

15. The electrical connector as claimed in claim 10, wherein a front carrier portion is linked between front ends of the power contacts at positions 4 and five, and another front carrier portion is linked between front ends of the power contacts at positions 9 and 8, and both said front carrier portion and said another front carrier are removed after the insert-molding process.

16. The electrical connector as claimed in claim 3, wherein the plurality of signal/ground contacts are further equipped with a first front carrier portion, and the plurality of power contacts are further equipped with a second front carrier portion, and the first front carrier portion is smaller than the second front carrier portion and both the first front carrier portion and the second front carrier portion are removed after the insert-molding process.

17. The electrical connector as claimed in claim 3, further including another insulative housing integrally formed with another row of contacts via another insert-molding process wherein said row of contacts and said another row of contacts are reversely symmetrically arranged with each other, and a metallic shielding plate sandwiched between said insulative housing and said another insulative housing in a vertical direction and joined together via an over-molding process.

18. The electrical connector as claimed in claim 15, wherein a bridge is connected between said front carrier portion and said another carrier portion in a transverse direction, and is removed along with said front carrier portion and said another carrier portion after the inset-molding process.

* * * * *